United States Patent [19]

Blaskowski

[11] 4,168,956

[45] Sep. 25, 1979

[54] METHOD OF OPERATING A COAL GASIFIER

[75] Inventor: Henry J. Blaskowski, West Simsbury, Conn.

[73] Assignee: Combustion Engineering, Inc., Windsor, Conn.

[21] Appl. No.: 825,492

[22] Filed: Aug. 18, 1977

[51] Int. Cl.[2] ..... C10J 3/46

[52] U.S. Cl. ..... 48/210; 48/197 R; 48/203; 48/DIG. 2

[58] Field of Search ..... 48/210, 203, 197 R, 48/76, 77, DIG. 2, DIG. 4; 110/28 R, 31; 122/5

[56] References Cited

U.S. PATENT DOCUMENTS

| | | | |
|---|---|---|---|
| 901,232 | 10/1908 | Eldred | 48/DIG. 4 |
| 1,039,398 | 9/1912 | Hirt | 48/DIG. 4 |
| 3,782,913 | 1/1974 | Donath | 48/210 |
| 3,840,353 | 10/1974 | Squires | 48/210 |
| 3,981,690 | 9/1976 | Chen et al. | 48/203 |

OTHER PUBLICATIONS

Patterson, "The Combustion Engineering Coal Gasification Program," pp. 28-34 of Combustion Magazine, May/1976.

*Primary Examiner*—S. Leon Bashore
*Assistant Examiner*—George C. Yeung
*Attorney, Agent, or Firm*—Edward L. Kochey, Jr.

[57] ABSTRACT

A method of operating an entrained flow coal gasifier which comprises the steps of firing coal at two levels in a combustion zone with near stoichiometric air, removing molten ash from the combustion zone, conveying combustion products upwardly from the combustion zone through a reduction zone, injecting additional coal into the combustion products in the reduction zone and gasifying at least a portion of the coal to form low BTU gas, conveying the gas to a point of use, including also reducing gasifier output by modifying the ratio of air to coal supplied to the upper level of the combustion zone so that the ratio becomes increasingly substoichiometric thereby extending the gasification of coal from the reduction zone into the upper level of the combustion zone, and maintaining the lower level of coal in the combustion zone at near stoichiometric conditions so as to provide sufficient heat to maintain effective slagging conditions.

4 Claims, 1 Drawing Figure

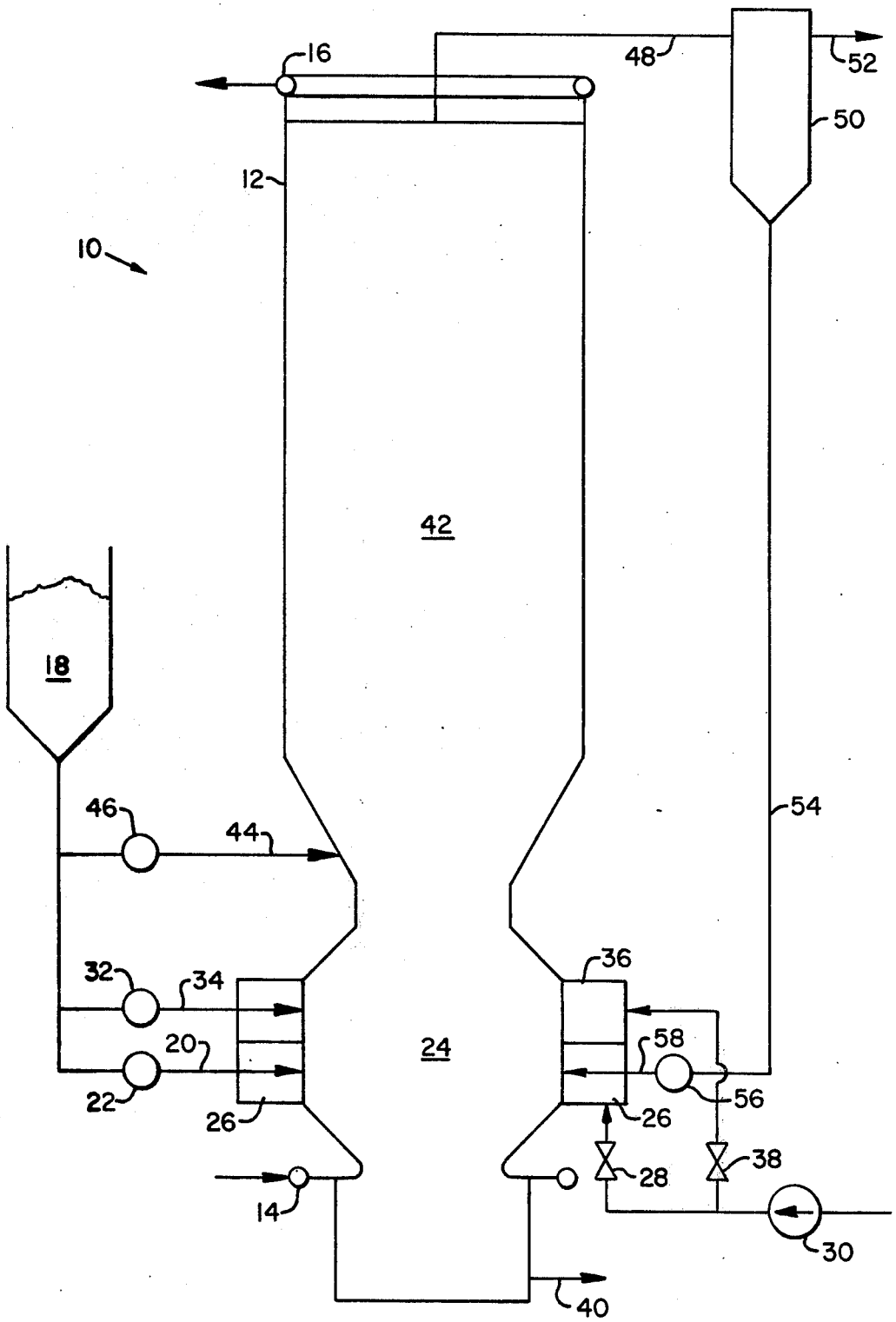
16
48
52
50
12
10
42
18
46
44
54
32
34
36
20
24
58
22
26
56
26
28
38
14
30
40

METHOD OF OPERATING A COAL GASIFIER

This invention resulted from work done pursuant to a contract with the Department of Energy.

BACKGROUND OF THE INVENTION

This invention relates to entrained flow coal gasifiers and in particular to a method of operating such gasifiers through a load range.

The entrained flow gasifier is essentially comprised of two zones. The first or the combustion zone generates the heat required for the gasification process. This zone is operated at near stoichiometric conditions to obtain the maximum heat and also to melt the ash so that it may be removed in the form of slag. As applied to combustion and gasification, stoichiometric is known to relates to the theoretical amount of oxygen required to completely burn the material being combusted. Where air is used this relates to the similar requirement of air. Off-stoichiometric relates to any ratio greater or less than the stoichiometric ratio while substoichiometric relates to a lesser amount of oxygen than required for theoretical complete combustion. The operation of this zone is off stoichiometric only to the extent required to reduce temperature where the materials forming the combustion zone cannot tolerate stoichiometric temperature.

The combustion products from the combustor zone are then mixed with incoming pulverized coal. The incoming coal is devolatilized and the carbon particles combine with the combustion products to form a gas which is largely carbon monoxide. This is an endothermic reaction obtaining its heat from the gases leaving the combustor. The gasification process continues until the temperature is reduced to a level at which the gasification rate is too slow for practical operation. Any remaining coal particles in the form of char may be recycled to the combustor.

After a gasifier is designed for optimum conditions at the maximum rating the same gasifier must be operated at reduced ratings. In such an operation the coal and air to the combustor is reduced while still maintaining stoichiometric conditions therein. Similarly the coal supplied to the reductor section is reduced in accordance with the reduced gas flow.

SUMMARY OF THE INVENTION

It is an object of the invention to increase the effectiveness of a gasifier when operating at reduced ratings.

In accordance with the invention, the combustor is fired at two levels. Load is reduced while maintaining stoichiometric proportions of air and fuel at the lower nozzle, thereby effecting the maximum gas temperature and the most effective slagging conditions. The coal and air supply at the upper level of nozzles in the combustor are modified so that the ratio becomes increasingly substoichiometric as load is reduced. Accordingly, a portion of the gasifying reaction which normally would occur in the reductor is obtained in the combustor. Actually by forcing the reaction to take place lower at low load we cause the gas making reaction to take place before the heat is absorbed by upper water walls increasing the heating level of gas and reducing the leaving temperature accordingly.

BRIEF DESCRIPTION OF THE DRAWING

The FIGURE is a schematic illustration of a gasifier.

DESCRIPTION OF THE PREFERRED EMBODIMENT

A gasifier generally indicated as 10 is formed of surrounding walls 12 formed of steam generating tubes. Water is supplied to the lower header 14 and exits through the upper header 16. Steam may be generated in these circuits to perform useful work.

Coal from bin 18 is supplied to a lower level of coal nozzles 20 through feeder 22. These nozzles are located at a plurality of locations around the combustor zone 24 and oriented for tangential introduction of coal therein. Lower wind box 26 similarly surrounds the combustor and supplies air which may be controlled in accordance with the coal passing through nozzle 20 by means of damper 28. The air is supplied by forced draft fan 30, although oxygen enriched air or pure oxygen may be used.

Additional coal may be supplied through feeder 32 to nozzles 34. A second wind box 36 surrounds the combustor in a location to supply air as desired in conjunction with coal nozzles 34. This air may be controlled by damper 38.

The ratio of air and fuel to the combustor 24 is maintained as near stoichiometric as possible considering the ability of the structural materials to withstand the temperature. Ash melts in the combustor and is removed through slag spout 40. The combustion products pass upwardly into reductor zone 42. In this zone additional coal is introduced through nozzles 44 in amounts controlled by feeder 46. This coal is devolatilized and gasified while undergoing an endothermic reaction with the combustion products from the combustor 24. Accordingly a low BTU gas is formed which exits through line 48. The gas passes through a dust collector 50 with the gas passing outwardly through line 52 for clean-up and use. Portions of the coal in the form of char are collected in dust collector 50 and returned through line 54 and feeder 56. These char particles are introduced through nozzles 58 into the lower portion of the combustor at a location similar to the introduction of coal through nozzles 20.

The gasifier is designed so that at the full load sufficient heat is generated in combustor 24 to satisfy the endothermic reaction. A portion of this heat is transferred to the walls. This heat transfer is a function of the temperature level of the gases at each location through the gasifier. The gasifier is also sized so that the exit temperature from reductor section 42 is about 1700 F at which point the rate of gasification is small.

When the output of this gasifier must be decreased the coal and/or char through nozzles 20 and 58 are maintained in proportion to the air flowing through wind box 26 to maintain near stoichiometric conditions in the lower portion of the combustor 24. The maximum temperature and most effective slagging conditions are thereby obtained. The maximum temperature is also available for the gasification reaction. The upper level of coal nozzles 34 are regulated in proportion to the air passing through wind box 36 in such a manner as to form substoichiometric conditions in the upper portion of the combustor 24 as the output is decreased, near stoichiometric conditions, preferably below stoichiometric but acceptably above stoichiometric, continue to be maintained in the lower level of nozzles 20. The upper level of nozzles 34 are regulated in conjunction with the air through windbox 36 to create increasing substoichiometric conditions as the gas output of the gasifier is decreased. A portion of the gasification is thereby accomplished in the combustor with the concomitant endothermic reaction. This decreases the gas temperature in that area and accordingly it decreases the heat loss to the walls. It follows that since less heat is lost to the walls, more is available for the gasification reaction. As the combustion products flow up into the reductor zone 42 additional coal is supplied through nozzles 44 in an amount required to complete the gasification reaction.

What is claimed is:

1. A method of operating an entrained flow coal gasifier comprising: firing coal at two levels in a combustion zone with near stoichiometric air; removing molten ash from said combustion zone; conveying combustion products upwardly from said combustion zone through a reduction zone; injecting additional coal into the combustion products in said reduction zone and gasifying at least a portion of the coal to form low BTU gas; conveying the gas to a point of use; including also reducing gasifier output by, modifying the ratio of air to coal supplied to the upper level of the combustion zone so that the ratio becomes increasingly substoichiometric thereby extending the gasification of coal from the reduction zone into the upper level of the combustion zone; and maintaining the lower level of coal in the combustion zone at near stoichiometric conditions so as to provide sufficient heat to maintain effective slagging conditions.

2. The method as in claim 1 wherein at least a portion of the coal fired to said combustor is in the form of char.

3. In a method operating an entrained flow coal gasifier comprising: firing coal at two levels in an upstream zone with near stoichiometric air at each level; removing molten ash from said upstream zone; conveying combustion products upwardly from said upstream zone through a downstream reduction zone; injecting additional coal into the combustion products in said downstream zone and gasifying at least a portion of the coal to form low BTU gas; conveying the gas to a point of use; the improvement comprising modifying the ratio of air to coal supplied to the upper level of the upstream zone so that the ratio becomes increasingly substoichiometric as the gas output of the gasifier is reduced, thereby extending the gasification of coal from the downstream reduction zone into the upper level of the upstream zone; and maintaining the lower level of coal in the upstream zone at near stoichiometric conditions so as to provide sufficient heat to maintain effective slagging conditions.

4. The method as in claim 3 wherein at least a portion of the coal fired to said combustor is in the form of char.

* * * * *